United States Patent [19]

Turney

[11] 4,022,441

[45] May 10, 1977

[54] UNIVERSAL TORCH

[75] Inventor: Larry R. Turney, Denton, Tex.

[73] Assignee: Victor Equipment Company, Denton, Tex.

[22] Filed: Nov. 28, 1975

[21] Appl. No.: 635,854

[52] U.S. Cl. ..... 266/48; 239/424.5
[51] Int. Cl.[2] ..... B23K 7/00
[58] Field of Search ..... 148/9 R; 239/424, 424.5; 266/48; 431/346

[56] References Cited

UNITED STATES PATENTS

| | | | |
|---|---|---|---|
| 1,044,651 | 11/1912 | Harris | 431/346 X |
| 1,262,351 | 4/1918 | Jones et al. | 239/400 |
| 1,276,893 | 8/1918 | Fischer | 239/132.3 |
| 1,340,699 | 5/1920 | Coberly | 431/346 |
| 2,198,342 | 4/1940 | Jacobsson et al. | 239/424.5 X |
| 2,263,655 | 11/1941 | Stettner | 285/388 |
| 2,275,491 | 3/1942 | Barna | 431/346 X |
| 2,655,992 | 10/1953 | Le Renard | 431/346 |
| 3,078,913 | 2/1963 | Anthes | 239/397.5 |
| 3,612,738 | 10/1971 | Jones et al. | 431/346 X |
| 3,873,028 | 3/1975 | Miller | 239/413 |

FOREIGN PATENTS OR APPLICATIONS

| | | | |
|---|---|---|---|
| 287,632 | 4/1953 | Switzerland | 239/424.5 |

*Primary Examiner*—Roy Lake
*Assistant Examiner*—Paul A. Bell
*Attorney, Agent, or Firm*—James C. Fails

[57] ABSTRACT

A torch that can employ any of the gaseous welding fuels, even at low pressure, without sustained burning on flashback, characterized by the usual tip, head, body, barrel, oxygen and fuel flow control valves, cutting oxygen valve, cutting oxygen tube assembly and pre-heat tube interconnecting the body and the head and having the improvement of having the pre-heat tube include a diffuser, an outer tube section for conveying the fuel, an inner tube section for conveying the oxygen, a mixer having a mixer orifice that causes the oxygen to be passed therefrom in a high speed jet for aspirating a low pressure fuel into admixture therewith, and a spiral disposed immediately upstream and adjacent the mixer. The mixer has a frusto-conical nose section and operates in conjunction with the spiral to break up any combustion wave that occurs on flashback and dissipate the heat associated therewith, so there is no sustained burning even if a flashback does infrequently occur.

4 Claims, 4 Drawing Figures

UNIVERSAL TORCH

BACKGROUND OF THE INVENTION

1. Field of the Invention

This invention relates to torches. More particularly, it relates to cutting torches having a plurality of tubes therewithin. In a particular aspect it relates to an improvement in cutting torches employing the injector type mixer.

2. Description of the Prior Art

The advent of welding solved many problems that had plagued manufacturers earlier. The use of torches, such as cutting torches, welding torches, heating torches and the like, also helped the repairman perform a variety of repairs on the site instead of having to return an article to the factory to be repaired. There have been employed in the prior art a wide variety of types of torches. One of the types is known as the injector type mixer in which one of the gases being flowed down a pre-heat tube is emitted in a high speed stream to aspirate the other gas into admixture therewith. In theory, the injector type mixers have offered more flexibility than any other type of mixer. In actual use, however, the injector type mixers have always had one major drawback, that being a tendency to have sustained burning on flashback, to burn up the torch when used with certain fuel gases, such as acetylene. Injector designers in the past have tried to get around this by limiting their use to only fuel gases that are difficult to make flashback or by restricting the pressure and orifice sizes, or tip sizes that can be employed.

The closest prior art of which I am aware is U.S. Pat. No. 2,198,342; although there are other patents extending back to U.S. Pat. No. 1,262,351, April, 1918, that show the use of mixing spirals. The patent U.S. Pat. No. 1,276,893, shows the intricate passageways to prevent backfiring of a torch. U.S. Pat. No. 2,263,655 shows a pipe coupling having a spiral fin 20. In the closest are U.S. Pat No. 2,198,342, the use of a mixer and an aspirating jet of oxygen is shown. Experience with that torch indicated, however, that sustained burning could be experienced on flashback unless the respective mixers and mixer orifices were changed out with different gases. Expressed otherwise, the blow pipe of U.S. Pat. No. 2,198,342 could be employed with certain gases, such as natural gas and the like that were normally resistant to flashback and sustained burning anyway; but could not be employed for acetylene, or other difficultly employed gases without changing out the mixer and the mixer orifice—an undesirable procedure.

Thus, in the prior art, the use of injector mixer type torches have required changing out the mixers and the mixer orifices for each of the fuels being employed or risk sustained burning on flashback so as to damage the torch.

SUMMARY OF THE INVENTION

Accordingly, it is an object of this invention to provide a torch that obviates the tendency to have sustained burning on flashback, yet still achieve the versatility of the injector type mixer torches.

It is a specific object of this invention to provide a cutting torch that has the versatility of the injector type mixers, can be operated on any of the gaseous welding fuels, even at low pressure, yet not have sustained burning on flashback even when flashback does occur.

These and other objects will become more clearly apparent from the following descriptive matter, particularly when taken in conjunction with the appended drawings.

In accordance with this invention, there is provided a torch, such as a cutting torch, that obviates the tendency to have flashback and sustained burning with certain fuels, such as acetylene, yet still achieve the flexibility theoretically inherent in the injector type mixer torches. The torch includes a torch head; a torch tip connected in fluid tight relationship with the torch head; a body having first and second passageways adapted to conforminly receive respective pre-heat tube assembly and cutting oxygen tube assembly; a barrel; a pre-heat tube assembly and a cutting oxygen tube assembly interconnecting the body with the head, cutting oxygen flow control valve sealingly connected with cutting oxygen tube assembly, the improvement characterized by having the pre-heat tube assembly that includes a diffuser section, an outer tube section for conducting fuel, an inner tube section for conducting oxygen, a mixer having a mixer orifice designed for emitting the oxygen in a high speed jet for aspirating a low pressure fuel into admixture therewith and a spiral disposed immediately upstream of and adjacent the mixer within the inner tube. The mixer and the spiral are so constructed as to dissipate any combustion wave and heat associated with a flashback and prevent sustained burning within the torch.

DESCRIPTION OF PREFERRED EMBODIMENTS

Figure 1:
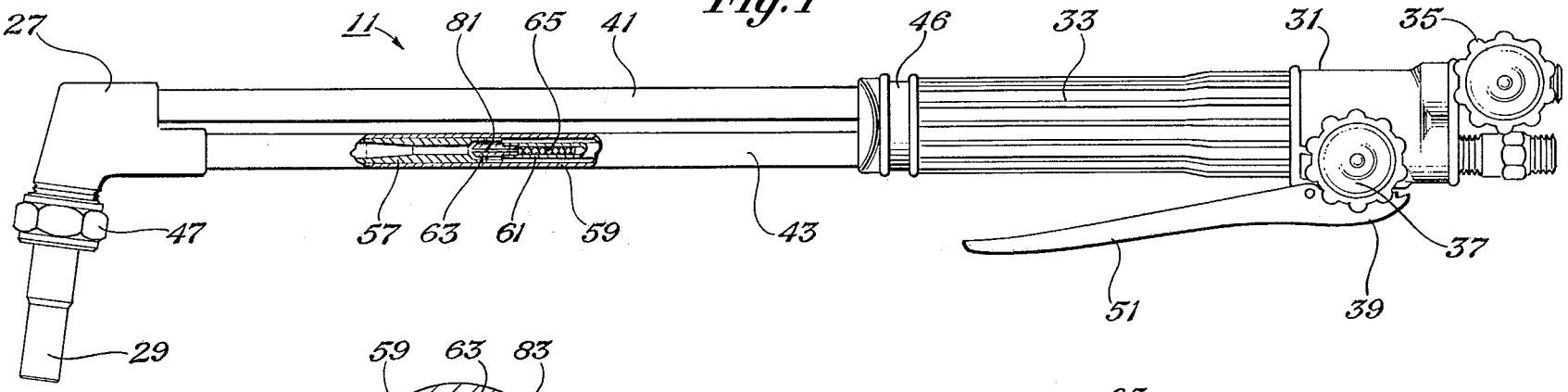
FIG. 1 is a side elevational view of a cutting torch in accordance with one embodiment of this invention.

Referring to FIG. 1, there is illustrated a cutting torch 11, such as is employed by a welder. The cutting torch 11 includes a torch head 27, a torch tip 29, a body 31, a barrel 33, a fuel flow control valve 35, an oxygen flow control valve 37, a cutting oxygen flow control valve 39, a cutting oxygen tube assembly 41, and a pre-heat tube assembly 43.

The torch head 27 is a so-called 90° torch head, such as employed by a welder to orient the torch tip at substantially 90° to the remainder of the torch to facilitate observation of the work being performed. If desired, the head may be a substantially straight head such as employed in machine welding operations, as described in my co-pending application entitled "Floating Tube Torch", Ser. No. 636,072, filed even date herewith, the contents of which are incorporated herein by reference for details omitted herefrom. In any event, the torch head 27 contains a pre-heat passageway and a cutting oxygen passageway. The cutting oxygen passageway terminates centrally of the torch head portion where the tip 29 will be affixed; whereas the pre-heat passageway terminates eccentrically thereof in a concentric bore that will form a concentric annular chamber in conjunction with the torch tip 29.

The torch tip 29 is a conventional cutting torch tip having a centrally disposed passageway for cutting oxygen and a plurality of passageways disposed concentrically thereabout for the mixture of fuel and oxygen. The torch tip 29 is a conventional torch tip that has a shoulder that sealingly abuts the mating portion of the torch head 27 such that the cutting oxygen passageways are isolated from the fuel and oxygen chamber and passageways, as illustrated and described more nearly completely in my hereinbefore referenced co-pending application Ser. No. 636,072. The torch tip 29 also has a frusto-conical section that is held sealingly in place by a tip nut 47 so the torch tip is connected in fluid tight relationship with the torch head 27.

The torch tip 29 and the torch head 27 are ordinarily formed of a corrosion resistant metallic alloy, such as copper alloy, stainless steel, or the like.

The cutting torch 11 has a body 31 that has respective first and second passageways for conformingly receiving the cutting oxygen tube assembly 41 and the pre-heat tube assembly 43. In accordance with conventional practice, the body 31 also has a fuel inlet passageway and an oxygen inlet passageway that are adapted to sealingly receive the respective fuel flow control valve 35 and oxygen flow control valve 37 and to conduct the respective gases to their respective conducting passageways as will be described in more detail hereinafter. The respective fuel inlet and oxygen inlet passageways are conventional and need not be described in further detail herein.

The body is ordinarily formed of a metallic alloy, such as a copper alloy, so as to resist corrosion, yet sustain the relatively rough treatment that is frequently accorded by the workman. As illustrated, the body 31 has an annular recess for receiving the barrel 33.

The fuel flow control valve and the oxygen flow control valve, similarly as the body 31, are conventional, and are described in other patents, such as U.S. Pat. No. 3,873,038, "Precision Torch Assembly", inventor Richard W. Miller, assigned to Victor Equipment Company, the contents of which are incorporated herein by reference.

The barrel 33 is connected with the body 31 at one end. It may be connected with the head 27 at its other end. In the illustrated embodiment, however, it terminates in a collar 46 that is disposed about and in receiving relationship with the respective tube assemblies 41 and 43. Ordinarily, the barrel 33 is advantageously metallic, although it may employ plastic cover or the like to reduce heat transmission to the hands. If desired, the barrel 33 may be affixed as by bonding, set screws, or the like. Employing the set screws with the barrel conformingly received by the body 31, facilitates disassembly so as to allow access to the cutting oxygen tube assembly and the pre-heat tube assembly therewithin.

The cutting oxygen tube assembly 43 includes a generally cylindrical tube that is sealingly connected at one end with the head 27 and is sealingly connected at its other end with the cutting oxygen flow control valve 39.

The cutting oxygen flow control valve 39 may be any of the conventional cutting oxygen flow control valves employed. The cutting oxygen flow control valves have changed little over the years and a satisfactory cutting oxygen flow control valve is illustrated in U.S. Pat. No. 2,198,342, the contents of which are incorporated herein by reference for the details omitted herefrom. The handle 51 on the cutting oxygen flow control valve may be pivotally mounted so as to be operable by the finger and on the same side as the torch tip 29; or it may be pivotally mounted on the diametrically opposite side of the body 31 so as to be operable with the thumb or hand of the welder. As long as it operates the poppet interiorly of the valve to control the flow of cutting oxygen, the arrangement is frequently altered in the same line of torches.

The cutting oxygen tube assembly includes a cutting oxygen tube, per se, that is formed of a material that is corrosion resistant to oxygen at the relatively high temperature that may be encountered. For example, it may be formed of stainless steel or a copper based alloy. As illustrated, the cutting oxygen tube is conformingly received and affixed as by silver soldering to the head 27 and is conformingly received and affixed to the body 31 in sealing relationship with the cutting oxygen flow passageway traversing through the body. If desired, it may be slidably received by the body 31, similarly as described and claimed in my hereinbefore referenced co-pending application Ser. No. 636,072. It is sufficient to note that the cutting oxygen flow control valve is operable, in conjunction with the oxygen inlet flow passageway and the cutting oxygen tube assembly 41 to conduct cutting oxygen to the cutting oxygen passageway in the torch tip 29 when the cutting oxygen flow control valve is opened for cutting.

The pre-heat tube assembly 43 includes a diffuser section 57, an outer tube section 59, an inner tube section 61, a mixer 63, and a spiral 65.

The diffuser 57 has a first bore 67 that is substantially cylindrical in shape and a frusto-conical bore 69 extending and flaring downstream therefrom. The frusto-conical bore 69 terminates at its downstream end with a substantially cylindrical bore 71 that is larger in diameter than the first bore 67. This structure effects substantially uniform admixing of the oxygen and the fuel gas, even when it is a low pressure gas that is aspirated into the oxygen stream. The diffuser section 57 may comprise a separate section that is sealingly connected onto the outer tube section 59. As illustrated, however, it comprises a section that is concentrically and conformingly fitted within the outer tube 59, and has an extending flange portion 73. AS illustrated also, the diffuser section 57 has a third bore 75 connected by an inverted frusto-conical section 77 at its upper end and connected with the first bore 67. The third bore 75 is adapted to receive the tip of the mixer 63 and still form an annular passageway thereabout.

The outer tube section 59 is sealingly connected with the fuel inlet passageway and the fuel flow control valve to provide a passageway for conducting the fuel to the diffuser 57.

The inner tube section 61 is connected in fluid tight relationship with the oxygen flow control valve and the oxygen inlet passageway for conducting the oxygen with which to admix and burn the fuel. The inner tube section 61 is disposed within the outer tube and connected so as to transmit the oxygen alone to a mixer where it will be admixed with the fuel gas. Typically, the inner tube section 61 will have at least one sealing shoulder to isolate the fuel passageway therefrom, and cause the fuel to pass along the longitudinal exterior concentric passageway. Any of the conventional connections can be employed to isolate the respective fuel and oxygen gas in their respective passageways in the pre-heat tube assembly until they reach the mixer 63.

Figure 4:
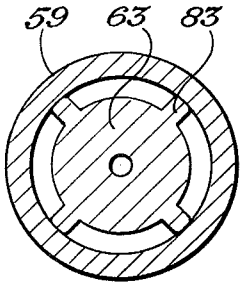
FIG. 4 is a cross sectional view taken along the lines IV—IV of FIG. 3.

The mixer 63 is disposed concentrically within the outer tube 59 and is connected, as by threaded connection 79 with the inner tube section 61. The mixer 63 has a mixer orifice 81 extending longitudinally thereof for dispensing the relatively high pressure oxygen in a high speed jet for aspirating a low pressure fuel into admixture therewith. To more efficiently effect this result, the mixer 63 has its nose portion received within the third bore 75 with the terminal, or downstream, end of the mixer orifice 81 set to discharge the aspirating high speed stream of oxygen into the throat, or first bore 67, of the diffuser section 57. The mixer 63, as illustrated better in FIG. 4, has a plurality of spacers 83 disposed thereabout for holding it concentrically within the outer tube section 59 so that the mixer orifice 81 will also be concentric with respect to the first bore 67. Consequently, an annular passageway 85 is defined for the fuel to flow about the inner tube section 61 and about the mixer 63.

The mixer 63 also has an inverted frusto-conical nose section 87 for deflecting a combustion wave, detonation wave, or the like into the annular passageway thereabout as will be discussed in greater detail hereinafter.

Figure 2:
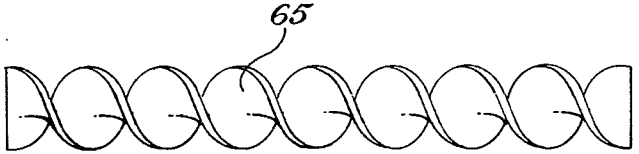
FIG. 2 is a side elevational view of the spiral within the pre-heat tube assembly of FIG. 1.
Figure 3:
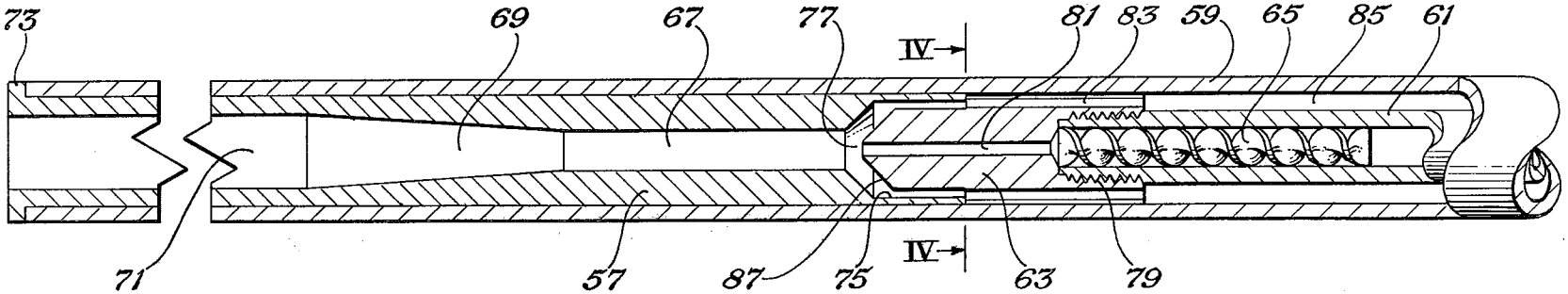
FIG. 3 is a partial cross sectional view of the pre-heat tube assembly of FIG. 1.

The spiral 65, FIGS. 2 and 3, is disposed within the inner tube section 61, adjacent and immediately upstream of the mixer 63. The spiral 65 is of a highly heat conductive material for conducting heat away from any portion of the combustion wave flashed into the inner tube section 61, for being cooled by flow of oxygen therepast, and being operable, in conjunction with the mixer 63 to prevent sustained burning from any flashback that occurs. As illustrated, the spiral 65 is formed of copper or a highly heat conductive copper based alloy. It is possible to employ aluminum or other heat conductive metals.

The reason for the criticality of employing the spiral is not clearly understood. It has been noted, however, that employing the mixer alone, as described in U.S. Pat. No. 2,198,342, did not prevent sustained burning when a flashback occurred; whereas employing the combination of the mixer and the spiral 65, all as described hereinbefore, resulted in relatively few flashbacks and no sustained burning upon flashback. While this invention is not to be limited to the consequences of any theory, it is theorized that the frusto-conical nose section 87 reflects any combustion wave, detonation wave, or the like outwardly into the annular passageway surrounding the mixer 63. The small mixer orifice 81 prevents any significant portion of the combustion wave from being transmitted to the bore within the inner tube section 61. Any small portion that is transmitted thereinto is dissipated by the spiral 65, simultaneously having the heat removed therefrom by the spiral 65. The portion of the detonation wave that travels up the annular passageway 85 causes the low pressure fuel gas therewithin to be compressed, moved away from the mixer 63. Consequently, oxygen can thereafter flow down the inner tube section 61, past the spiral 65, out the mixer orifice 81 and the diffuser 57 before fuel is again supplied. After the detonation wave in the fuel portion is dissipated, low pressure fuel again begins to flow down the annular passageway 85 responsive to the low pressure induced by the aspirating high speed jet of oxygen. Finally, fuel gas is again supplied to the torch tip 29 so that combustion is again initiated at the torch tip in normal burning. There is no sustained burning within the pre-heat tube as in the prior art torches. On the contrary, the flame pops back to the torch tip for normal operation with any fuel.

In operation, the torch 11 is assembled as illustrated and described hereinbefore and connected by appropriate hoses at the respective oxygen and fuel inlet passageways and valves with respective oxygen and fuel sources. The desired heating flame is provided at the tip 29 by adjusting the fuel and oxygen flow control valves 35 and 37. The work piece is then heated until molten metal is achieved. This time, the lever 51 is pulled toward the barrel 33 to open the cutting oxygen flow control valve and start the cutting operation. The cutting oxygen further effects burning and melting of the metal and flowing of the molten metal from the cuts being made. The desired operation is completed. The cutting oxygen flow control valve is turned off. Thereafter, the oxygen and fuel flow control valves 35 and 37 are turned off until it is desired to employ the torch again.

While the manually operated cutting torch embodiment has been described herein, the improved pre-heat tube of this invention can be employed in machine cutting torches and the like to advantage, such as described in my hereinbefore references patent application Ser. no 636,072.

Although cutting an oxygen flow control valve for a manually operated torch has been described hereinbefore, it may comprise a combination of a conventional valve and a solenoid operated valve for controlling the cutting oxygen flow, as in a machine torch.

One advantage of this invention is that the materials of construction that are ordinarily employed in manufacturing torches can be employed herein and no exotic new materials or expensive operations are necessary.

The significant advantage of this invention is that the torch 11 achieves all of the objects delineated hereinbefore. Specifically, the torch 11 achieves the advantages theoretically inherent in injector mixer type torches, yet can be universally employed; that is, can be employed with any of the gaseous welding fuels—even at low pressure and even the fuels like acetylene that tend to flashback—without changing mixer orifice sizes, mixers, or the like!

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A cutting torch that can employ any of the gaseous welding fluids at pressures as low as eight ounces per square inch without sustained burning on flashback comprising:

a. a torch head;
b. a torch tip connected in fluid tight relationship with said torch head;
c. a body having a fuel inlet passageway and an oxygen inlet passageway;
d. a fuel flow control valve sealingly connected with said fuel inlet passageway;
e. an oxygen flow control valve sealingly connected with said oxygen inlet passageway;
f. a cutting oxygen passageway connected with said oxygen inlet passageway upstream of said oxygen flow control valve;
g. a cutting oxygen flow control valve connected with said oxygen inlet passageway;

h. a cutting oxygen tube assembly sealingly connected with said cutting oxygen flow control valve; and i. a pre-heat tube assembly that includes:

a diffuser section adjacent the end of said pre-heat tube assembly nearest said torch head; said diffuser section having at least one substantially cylindrical bore and connected therewith a frusto-conical bore that flares downstream;

an outer tube section for passage of the fuel; said outer tube section being connected in fluid tight relationship with said fuel inlet passageway and said fuel flow control valve;

an inner tube section for passage of the oxygen with which to admix and burn said fuel; said inner tube section being disposed within said outer tube section and connected at its first end in fluid tight relationship with said oxygen inlet passageway and said oxygen flow control valve so as to transmit via its interior said oxygen alone to a mixer where it will be admixed with said fuel, and define an annular passageway thereabout for said fuel alone to said mixer;

a mixer disposed within a surrounding tube member in communication with said diffuser and the annular passageway defined thereby; said mixer being connected with the second end of said inner tube section; said mixer having a mixer orifice extending longitudinally thereof for passing the relatively high pressure oxygen therefrom in a high speed jet for aspirating a low pressure fuel into admixture therewith in said diffuser; said mixer orifice being disposed downstream of said oxygen flow control valve and a spiral and having a length greater than four times its diameter for minimizing turbulence and forming an aspirating high speed jet that enables use of the torch with a plurality of fuels at a plurality of pressures; said mixer having at its free end an internal frusto-conical section that flares upstream for deflecting a detonation wave outwardly into said annular passageway disposed thereabout for said fuel; and a spiral disposed within said inner tube section downstream of said oxygen flow control valve and adjacent and upstream of said mixer and said mixer orifice; said spiral being of a highly heat conductive material for conducting heat away from any portion of a combustion wave flashed thereinto to extinguish the combustion, being cooled by a flow of oxygen therepast and being operable in conjunction with said mixer to prevent sustained burning from a flashback that occurs in said torch.

2. The torch of claim 1 wherein said mixer is disposed concentrically within said outer tube section such that said mixer orifice ejects said high velocity oxygen into the straight bore of said diffuser for maximum efficiency in aspirating said fuel into admixture with said oxygen in said diffuser.

3. The torch of claim 2 wherein said spiral is metallic.

4. The torch of claim 3 wherein said metallic spiral comprises copper.

* * * * *